US006076902A

United States Patent [19]

Rodriguez

[11] Patent Number: 6,076,902

[45] Date of Patent: Jun. 20, 2000

[54] TV CENTER ORGANIZER

[76] Inventor: Frankie Rodriguez, P.O. Box 1360, Moca, Puerto Rico 00676

[21] Appl. No.: 09/371,516

[22] Filed: Aug. 10, 1999

[51] Int. Cl.[7] ..... A47N 81/06

[52] U.S. Cl. ..... 312/7.2

[58] Field of Search ..... 312/7.2, 223.1, 312/223.3, 114, 117, 257.1, 265.6, 284, 290; D6/436, 437, 441, 443, 449, 470

[56] References Cited

U.S. PATENT DOCUMENTS

| | | | |
|---|---|---|---|
| D. 244,820 | 6/1977 | Freeman . | |
| D. 340,152 | 10/1993 | Short | D6/436 |
| D. 346,695 | 5/1994 | Williams | D6/436 X |
| D. 354,638 | 1/1995 | Todd et al. | D6/433 |
| D. 367,383 | 2/1996 | Hatrick-Smith | D6/436 X |
| D. 373,032 | 8/1996 | Williamson-Markman | D6/437 |
| 859,787 | 7/1907 | Summer | 312/114 X |
| 2,119,102 | 5/1938 | Flaherty | 312/7.2 X |
| 3,467,455 | 9/1969 | Caldemeyer | 312/7.2 |
| 3,672,741 | 6/1972 | Clark | 312/7.2 |
| 4,471,586 | 9/1984 | Shuch et al. . | |
| 4,702,534 | 10/1987 | Witt et al. | 312/114 |
| 5,833,334 | 11/1998 | Harper | 312/265.6 X |

FOREIGN PATENT DOCUMENTS 2444422 7/1980 France .

*Primary Examiner*—Peter M. Cuomo
*Assistant Examiner*—James O. Hansen
*Attorney, Agent, or Firm*—Richard C. Litman

[57] ABSTRACT

The TV center organizer for organizing and retaining a variety of electronic devices and corresponding storage media has a central shell structure having first and second ridges for slidable attachments, a housing for a television, a base portion, a plurality of interior storage compartments, a first slidable shell and a second slidable shell with respective first and second recesses, and a top portion. The first and second slidable shells conceal interior storage compartments in a first state and provide access to said interior storage compartments in a second state. The central shell includes a recessed and inclined plane for mounting a clock therein. The top portion has a central storage compartment with first and second arcuate and transparent storage covers hingedly attached at opposing ends of the central storage compartment. A number of covered and uncovered storage compartments are disposed within the central storage compartment for items such as remote control devices or similar sized articles. The organizer is oblong and tapered in shape, having a larger surface at the base and narrowing in surface area at the top portion.

7 Claims, 2 Drawing Sheets

TV CENTER ORGANIZER

BACKGROUND OF THE INVENTION

1. Field of the Invention

The present invention relates generally to cabinets. More specifically, the invention is an entertainment center organizer for retaining and organizing a variety of electronic devices.

2. Description of the Related Art

Numerous entertainment centers are available in the market place having a variety of storage features for household or electronic products such as televisions (TVs), radio receivers, compact disc players, etc. However, the driving factor for the over abundance of these centers in most households, now available, has not been from the basic utility of the center, but includes certain structural features which have both utility and aesthetic appeal. The "element of surprise" has factored into the equation, and has always served to produce intrigue or to capture the interests of family, friends and relatives for showing off the latest and greatest family "jewels". The TV center organizer as herein described does just that. It is an improved entertainment center having numerous compartments as concealed and transparent storage areas for tapes, compact discs, etc. A set of slidable shells are formed within the center encompassing central side portions which conceals a plurality of interior compartments in a closed state. An entertainment center which provides the structural features as herein described is lacking.

For example, U.S. Pat. No. 3,467,455 issued to Caldemeyer discloses an entertainment center having a TV stand which rotates on its axis and includes mounts which provides similar rotation for speakers disposed on left and right sides of the TV housing and stand. The center contains two lower sliding drawers and four hindged cabinets for storing various items.

U.S. Pat. No. 4,471,586 issued to Schuch et al. discloses an independent shop in the form of a newspaper kios comprising a cell of trapezoidal shape and having a supporting structure formed by at least four supporting posts located at the four corners of the trapezium. The structure includes a network of interconnected cross-members as a roof framework. The posts act as supports for mounting product display box structures.

U.S. Pat. No. 4,702,534 issued to Witt et al. discloses a winged display case having a center enclosure, suited for containing trophies or other memorabilia, equipped with hinge, mounted opposite glass faced picture mounting wings. The center enclosure is made of a number of different shaped structures including triangular, oval or octagonal.

U.S. Design Patents issued to Freeman (Des. 244,820), Short (Des. 340,152), Williams (Des. 346,695), Todd et al. (Des. 354,638), Hatrick-Smith (Des. 367,383) disclose ornamental design features of entertainment centers of general relevance to the TV center organizer as herein described. The French Patent No. 2 444 422 issued to Pellini discloses common features generally related to entertainment centers, including hinged outer shelves which rotate outward on left and right sides of a central shelf area for storing additional items.

None of the above inventions and patents, taken either singularly or in combination, is seen to describe the instant invention as claimed. Thus a TV center organizer solving the aforementioned problems is desired.

SUMMARY OF THE INVENTION

The TV center organizer for organizing and retaining a variety of electronic devices and corresponding storage media according to the invention includes a central shell structure having first and second ridges for slidable attachments, a housing for a television, a base portion, a plurality of interior storage compartments, a first slidable shell and a second slidable shell with respective first and second recesses, and a top portion. The first and second slidable shells conceal interior storage compartments in a first state and provide access to said interior storage compartments in a second state. The central shell includes a recessed and inclined plane for mounting a clock therein. The top portion has a central storage compartment with first and second arcuate and transparent storage covers hingedly attached at opposing ends of the central storage compartment. A number of covered and uncovered storage compartments are disposed within the central storage compartment for items such as remote control devices or similar sized articles. The organizer is oblong and tapered in shape starting from the base and narrowing at the top portion. The resulting structure is simple to manipulate having a reduced number of mechanical compartment enclosures.

Accordingly, it is a principal object of the invention to provide an improved TV center organizer for housing electronic components and corresponding storage media.

It is another object of the invention to provide an improved TV center organizer having maximum storage capacity and less material requirements.

It is a further object of the invention to provide an improved TV center organizer which is simple to manipulate and use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a TV center organizer for organizing and retaining a variety of electronic devices such as shelf stereo systems or the like and corresponding storage media M. The preferred embodiment of the present invention is depicted in FIGS. 1–2, and is generally referenced by numeral 3.

Figure 1:
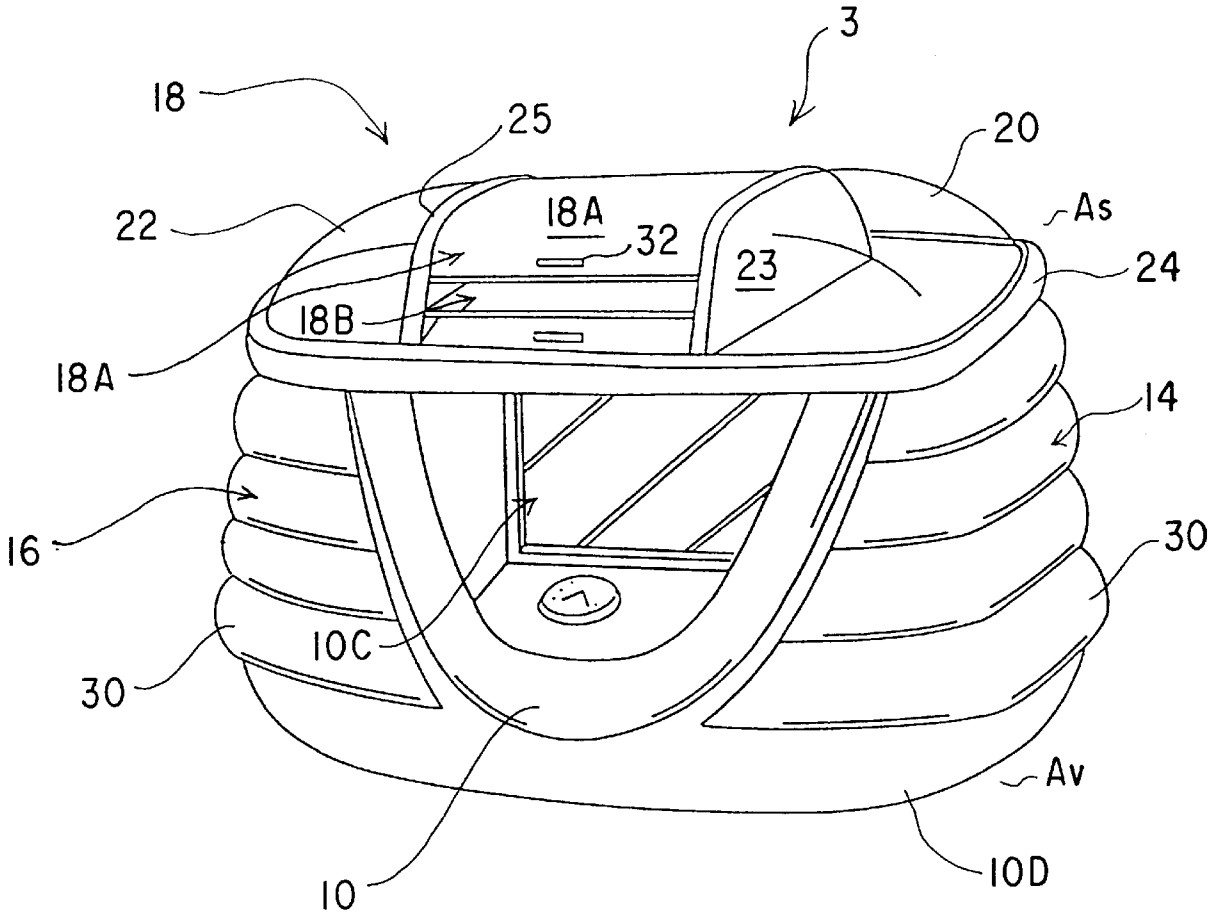
FIG. 1 is a perspective view of a TV center organizer according to the present invention.
Figure 2:
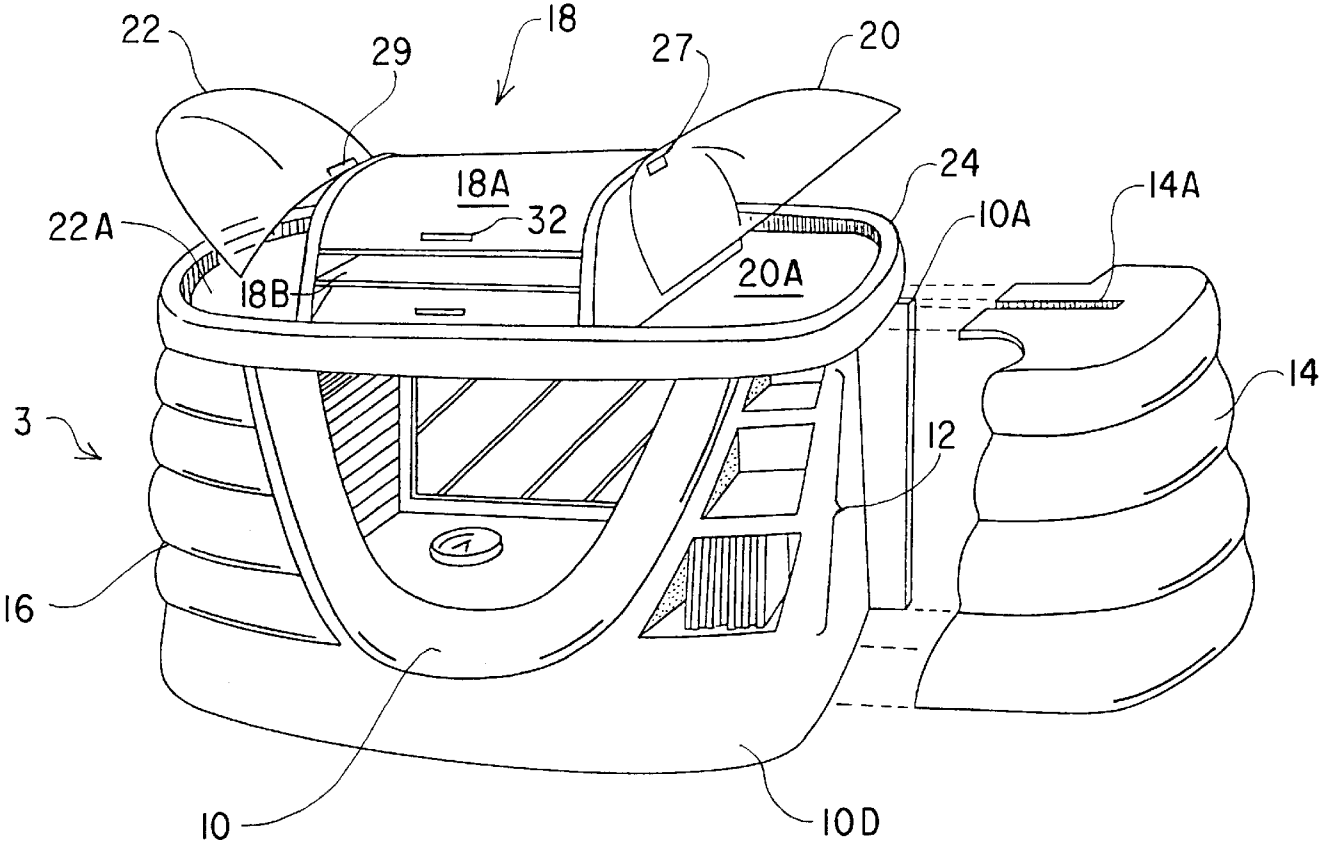
FIG. 2 is a perspective exploded view of the TV center organizer according to the invention, illustrating a retracted side storage panel concealing multiple interior storage compartments.

As diagrammatically illustrated in FIGS. 1–2, the TV center organizer 3 comprises a central shell structure 10 having first 10*a* and second 10*b* ridges for slidable attachments, a housing 10*c* for a television, a base portion 10*d*, a plurality of interior storage compartments 12, a first slidable shell 14 and a second slidable shell 16 having first and second recesses 14*a*, 16*a* respectively, and a top portion 18.

The first 14 and second 16 slidable shells conceal the interior storage compartments 12 in a first or closed state as diagrammatically illustrated in FIG. 1 and provide access to the interior storage compartments 12 in a second or open state as diagrammatically illustrated in FIG. 2. The central shell structure 10 includes a recessed and inclined plane 11 for mounting a clock therein. The top portion 18 includes a central storage compartment 18*a* and first 20 and second 22 arcuate storage covers attached at opposing ends 23 and 25 of the central storage compartment 18*a*.

The central storage compartment 18*a* comprises at least one covered storage compartment 18*b* and at least one recessed storage compartment 18*c* arranged or disposed in a stacked configuration. The top portion 18 also includes a peripheral border 24 which forms arcuate shaped sunken compartments 20*a* and 22*a* for the respective first 20 and second 22 storage covers. The base portion 10*d* of the central shell structure 10 has a larger surface area $A_L$ than the surface area $A_S$ of the top portion. The housing 10*c* is constructed to form a substantially U-shaped housing or cavity for retaining a TV of various sizes. Since dimension characteristics do not serve to distinguish the inventive features as herein described, it would be obvious to one having ordinary skill in the art to provide the TV center organizer in any desired dimension as a matter of intended use. Accordingly, the first 14 and second 16 slidable shells are shaped and dimensioned to slidably and fixedly attach to the first 10*a* and second 10*b* ridges of the central shell structure 10.

A diagrammatically illustrated in both figures first 14 and second 16 slidable shells are tapered shells decreasing in area from the base of the shell up to the top portion of the shell, include a plurality of respective arcuate rib sections 30 formed therein. With respect to first 20 and second 22 arcuate storage covers, they are preferably made of a transparent material such as glass or plastic to provide an open aesthetic appeal. In addition, each cover 20,22 is hingedly attached to the central storage compartment 18 at first 27 and second 29 top central locations identifying the opposing ends 23,25. The TV center organizer 3 according to the invention is made out of a combination of wood and plastic material according to a predetermined aesthetical preference or appeal. Other unique features include the of at least one recessed handle portion 32 which minimizes mechanical failure related to knobs or the like typically attached thereto.

It is to be understood that the present invention is not limited to the embodiment described above, but encompasses any and all embodiments within the scope of the following claims.

I claim:

1. A TV center organizer for organizing and retaining a variety of electronic devices and corresponding storage media comprising:

a central shell structure having first and second ridges for slidable attachments, a housing for a television, a base portion, a plurality of interior storage compartments, a first slidable shell and a second slidable shell having first and second recesses, and a top portion, the first and second slidable shells conceal said interior storage compartments in a first state and provide access to said interior storage compartments in a second state, the central shell includes a recessed and inclined plane for mounting a clock therein, the top includes a central storage compartment and first and second arcuate storage covers attached at opposing ends of said central storage compartment, the central storage compartment comprises at least one covered storage compartment and at least one recessed storage compartment in a stacked configuration, the top portion includes a peripheral border which forms an arcuate compartment for said first and second storage covers, and the base of the shell having a larger surface area than the surface area of the top portion.

2. The TV center organizer according to claim 1, wherein said housing is a substantially U-shaped housing.

3. The TV center organizer according to claim 1, wherein said first and second slidable shells slidably and fixedly attaches to said first and second ridges of the central shell.

4. The TV center organizer according to claim 3, wherein said first and second slidable shells are tapered shells decreasing in area from the base of the shell up to the top portion of the shell, and having a plurality of respective arcuate rib sections formed therein.

5. The TV center organizer according to claim 1, wherein said first and second arcuate storage covers are made of a transparent material and are hingedly attached to said central storage compartment at a first and second top central location of said opposing ends.

6. The TV center organizer according to claim 1, wherein the organizer is made of a combination of wood and plastic material and is oblong in shape.

7. The TV center organizer according to claim 1, wherein the central storage compartment includes at least one recessed handle portion.

* * * * *